US007897307B2

(12) United States Patent
Iftime et al.

(10) Patent No.: US 7,897,307 B2
(45) Date of Patent: Mar. 1, 2011

(54) MARKING MATERIAL WITH BIREFRINGENT NANOPARTICLES

(75) Inventors: Gabriel Iftime, Mississauga (CA); Peter M. Kazmaier, Mississauga (CA); C. Geoffrey Allen, Waterdown (CA); Paul F. Smith, Oakville (CA)

(73) Assignee: Xerox Corporation, Norwalk, CT (US)

( * ) Notice: Subject to any disclaimer, the term of this patent is extended or adjusted under 35 U.S.C. 154(b) by 993 days.

(21) Appl. No.: 11/554,133

(22) Filed: Oct. 30, 2006

(65) Prior Publication Data

US 2008/0145777 A1 Jun. 19, 2008

(51) Int. Cl.
*G03G 9/09* (2006.01)

(52) U.S. Cl. ..... 430/10; 283/904; 382/321; 380/54; 430/108.6; 430/108.1; 430/115; 523/153; 523/160

(58) Field of Classification Search ..... 430/108.6, 430/115, 10; 523/153, 160
See application file for complete search history.

(56) References Cited

U.S. PATENT DOCUMENTS 5,807,625 A 9/1998 Amon et al.
6,114,077 A * 9/2000 Voets et al. ..... 430/97
2003/0186148 A1* 10/2003 Nakamura et al. ..... 430/107.1
2003/0186151 A1* 10/2003 Nakayama et al. ..... 430/108.6
2004/0024091 A1* 2/2004 Yamada et al. ..... 523/160
2004/0220298 A1 11/2004 Kozee et al.
2004/0233465 A1 11/2004 Coyle et al.
2006/0189712 A1* 8/2006 Kondo ..... 523/160

FOREIGN PATENT DOCUMENTS

EP 0280378 * 2/1988

OTHER PUBLICATIONS

Diamond, "Handbook of Imaging Materials," Marcel Dekker, NY, NY 1991. p. 527-529.*
Kohji Yoshinaga, Ch. 12.1, Surface Modification of Inorganic Particles, in Surfactant Science Series published 2000 by CRC Press, p. 626-627. Obtained from Google Books website: http://books.google.com/books?id=lurWPtFnTRsC&pg=PA626&lpg=PA626&dq=Surface+Modification+of+Inorganic+particles+Yoshinaga&source=bl&ots=m-Odxsr6DX&sig=XEolzoh9DUeb0ZyQwaQ.*

* cited by examiner

*Primary Examiner*—Christopher RoDee
*Assistant Examiner*—Peter L Vajda
(74) *Attorney, Agent, or Firm*—Oliff & Berridge, PLC

(57) ABSTRACT

Disclosed is a birefringent marking material comprising a vehicle for the marking material and birefringent nanoparticles having an average particle size of less than about 700 nm. The birefringent marking material, such as an ink or a toner, can be used to provide a security marking on or in an item, thereby enabling authentication of the item containing the image formed using the birefringent marking material.

17 Claims, 1 Drawing Sheet

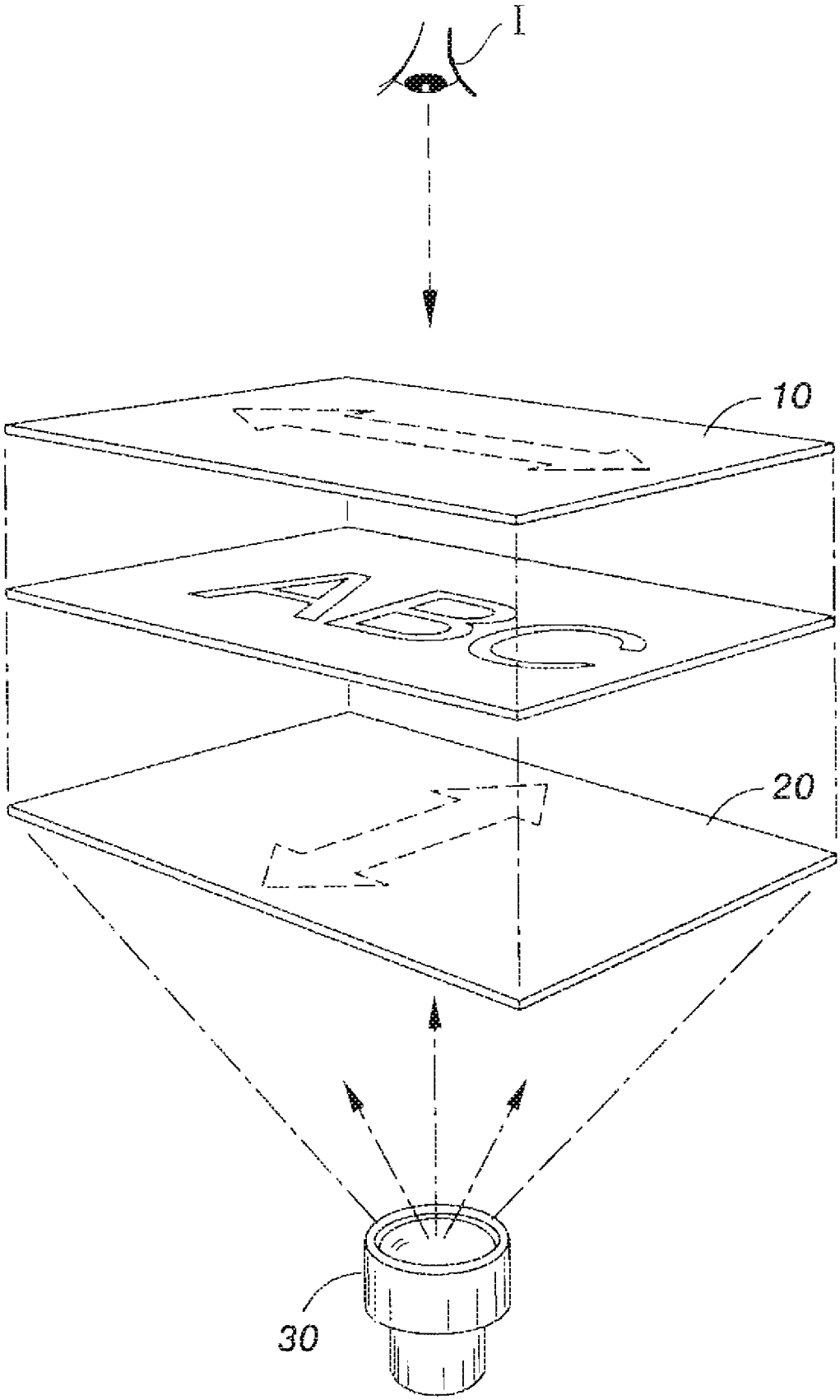
I
10
ABC
20
30

MARKING MATERIAL WITH BIREFRINGENT NANOPARTICLES

BACKGROUND

Described herein are marking materials, for example inks and toners, including liquid and solid (phase change or hot melt) inks, that contain birefringent nanoparticles therein. The inks may be used in a number of copying and printing devices for forming images on an image receiving substrate such as paper, plastic and the like.

The inks and toners described herein offer the advantage of enabling images formed using the inks and toners to include a unique security feature. For example, images formed with the inks and toners herein appear normally to a viewer under most viewing conditions, but unlike typical inks and toners, are also able to appear when placed between crossed polarizers. The inks can thus be used to create a security feature in documents, plastic cards, and the like, wherein the authenticity of the item can be verified by placement of the image therein or thereon between crossed polarizers; images such as forgeries formed with a different ink or toner would not appear under the crossed polarizers, thereby exposing the counterfeit nature of the item.

REFERENCES

As copying devices become more sophisticated, it is becoming increasingly difficult and expensive to ensure the authenticity of items that include printed images therein and/or thereon, for example such as documents, including commercial paper, credit cards, and the like. Various techniques have been used to attempt to deal with this issue.

U.S. Patent Publication No. 2004/0220298 describes an ink composition suitable for ink jet printing comprising a luminescent compound, a solvent, and an energy active compound, and optionally a non-luminescent colorant. The energy active compound, when exposed to energy, generates one or more active species that can react with the luminescent compound to alter one or more of the characteristics of the luminescent compound. The luminescent compound can be colored or colorless. Further disclosed is a jet ink composition suitable for printing on substrates authentication or security marks which can be rendered unreadable. The luminescence of the mark is quenched and the visible color is changed when irradiated with a light.

U.S. Patent Publication No. 2004/0233465 describes an article marked with image indicia for authentication, information, or decoration by providing a plurality of inks having a plurality of fluorescence colors when exposed to excitation energy, separating colors of the image indicia into a plurality of image levels in accordance with the fluorescence colors of the inks, and printing each image level in mutual registration on the article using the corresponding ink. The image printed with each ink may be substantially invisible under illumination within the visible spectrum. The invisibly printed images have multiple authentication features, including the use of covert UV-fluorescent materials, IR-fluorophores, microparticles, and other chemical taggants.

U.S. Pat. No. 5,807,625 describes photochromic printing inks that are used for the printing of security documents. Prints are normally nearly colorless and become colored when energy irradiated, such as by ultraviolet light. This photocoloration is reversible. The printing inks contain photochromic compounds which are protected against other ink components. Methods are described to prepare the inks, to print security documents, and to detect counterfeiting.

While attempts have been made in general to provide inks capable of making counterfeiting difficult and/or capable of providing security features in documents, there is still a need for inks and/or toners that can provide such capabilities in a unique manner, and ideally in a cost effective manner.

The ink and toner marking materials described herein are suitable for fulfilling one or more of the above needs. These and other advantages of the inks and toners, as well as additional inventive features, will be apparent from the following description.

SUMMARY

Described is a birefringent marking material comprising a vehicle for the marking material and birefringent nanoparticles having an average particle size of less than about 700 nm.

Marking material sets comprising at least one birefringent marking material comprised of the birefringent marking material and at least one non-birefringent marking material that is substantially free of crystalline materials are also described. For example, described is a marking material set comprised of at least three differently colored marking materials, wherein at least one but not all of the differently colored marking materials is a birefringent marking material.

Also described is an image receiving substrate comprised of a non-crystalline material and having an image thereon, wherein a portion comprised of less than all of the image is formed from a birefringent marking material comprising a vehicle and birefringent nanoparticles having an average particle size of less than about 700 nm.

Further, described is a method of authenticating an item comprised of the image receiving substrate, comprising locating the item between two crossed polarizers, wherein under exposure to light, only the portions of the image formed from the birefringent marking material is visible.

Still further, described is a system for preparing and autheticating items, comprising an image forming device including at least one birefringent marking material comprising a marking vehicle and birefringent nanoparticles having an average particle size of less than about 700 nm, wherein the device receives an image forming substrate and forms an image thereon, at least a portion of the image formed from the birefringent marking material, and an authenticating device comprising a light source and two crossed polarizers capable of receiving therebetween an item comprised of the image receiving substrate.

BRIEF DESCRIPTION OF THE DRAWING

The FIGURE illustrates an image including a portion, but not all, formed from a birefringent marking material, and located between crossed polarizers with a light source so as to expose the birefringence.

EMBODIMENTS

In embodiments, described is a marking material comprising a vehicle for the marking material and birefringent nanoparticles having an average particle size of less than about 700 nm. The marking material may have any suitable form, for example solid or liquid form, and may comprise, for example, an ink, a solid ink, a toner, and the like, The birefringent nanoparticles may exhibit birefringence via any suitable route. Desirably, the nanoparticles exhibit birefringence as a result of being crystalline. Crystalline refers to, for example, that the nanoparticles have some degree of crystallinity, and thus crystalline is intended to encompass both semicrystalline and fully crystalline nanoparticles. The nanoparticles are considered crystalline when comprised of crystals with some regular arrangement of atoms in a lattice.

Birefringence, such as linear birefringence, is a property of a material referring to the splitting of a light wave into two unequally reflected or transmitted waves by an optically anisotropic medium. Linear birefringent materials such as crystals have an anisotropic structure which makes them appear bright when placed between crossed polarizers. An isotropic material, on the other hand, will appear dark so as to not be visible under the same crossed polarizers.

In the marking materials herein, nanoparticles are employed as a material imparting birefringence to the marking material. The nanoparticles may be chosen to have a sufficiently small size so as not to scatter incident light, and as a result the image formed from the marking material containing nanoparticles appears clear and/or to have a color of any colorant included in the marking material under ambient light viewing conditions.

The nanoparticles may have an average particle size of less than about 700 nm, for example of from about 1 nm to about 700 nm. In embodiments where it is desired that the nanoparticles are not visible to a viewer, for example where the nanoparticles do not contribute to the color appearance of the marking material, the nanoparticles desirably have an average particle size of less than about 300 nm, for example of from about 1 nm to about 300 nm, from about 10 nm to about 250 nm or from about 10 nm to about 200 nm. Nanoparticles of such a small average particle size do riot exhibit a perceptible color to a viewer of the image formed from the marking material, and thus are suitable for use in clear marking materials and/or in marking materials where an optional colorant added to the marking material is desired to be the only color perceptible to a viewer of an image formed using the marking material. Larger sized nanoparticles, for example having a size of larger than about 300 nm, for example from about 301 nm to about 700 nm or from about 350 nm to about 600 nm, may have a perceptible white color. As such, these larger sized nanoparticles may be used where it is desired that the white appearance provided by the nanoparticles contribute to the color of the marking material. The average size of the nanoparticles may be determined via any suitable technique and device, for example via use of a Brookhaven nanosize particle analyzer or similar device.

When using the larger size nanoparticles in embodiments where an image is formed using two marking materials of the same color, only one of which provides the necessary birefringence as a result of containing the larger sized nanoparticles, it is then necessary to similarly adjust the color of the other non-birefringent marking material to account for the whiteness provided by the nanoparticles in the birefringent marking material. Otherwise, the colors may not match adequately, which can result in an image of poor quality where a viewer perceives the color differential among the two marking materials. Such similarly or same colored marking materials may be used together when forming an image where it is desired that only portions of the image exhibit birefringence.

In embodiments, the nanoparticles are comprised of organic or inorganic nanoparticles. Desirably, the nanoparticles are inorganic. Examples of inorganic nanoparticles include, for example, titanium dioxide, aluminum oxide, silicon dioxide, zinc oxide, combinations thereof and the like.

The nanoparticles may be commercially available, for example from Sigma-Aldrich. Alternatively, synthetic procedures for making nanoparticles have been reported in the literature. For example titanium dioxide nanoparticles may be obtained by hydrolysis of titanium tetrachloride in aqueous hydrochloric acid solution. Another procedure starts from tetrabutyl titanate that is hydrolyzed in andydrous ethanol in the presence of hydrochloric acid as a catalyst. Zinc oxide may be obtained staring from zinc chloride powder.

To exhibit satisfactory birefringence, the nanoparticles may be included in the marking material in an amount of from, for example, about 0.1% to about 40% by weight, such as from about 1% to about 25% by weight or from about 2% to about 10% by weight, of the marking material.

As the vehicle of the marking material, any suitable vehicle presently knowvn in the ait or that may become known in the future may be used, so long as it is not a birefringent material. As above, the vehicle may have a liquid or solid form, and suitable marking material vehicles include, for example, liquid ink or developer vehicles, solid ink vehicles, radiation curable vehicles, toner vehicles and the like.

As liquid vehicles, examples may include a liquid with an effective viscosity of, for example, from about 0.5 to about 500 centipoise, such as from about 1 to about 20 centipoise. The liquid may be a branched chain aliphatic hydrocarbon. A nonpolar liquid of the ISOPAR series, comprised of isoparaffinic hydrocarbon fractions and manufactured by the Exxon Corporation may be used. Additional commercially available hydrocarbon liquids that may be used include, for example, the NORPAR series available from Exxon Corporation, the SOLTROL series available from the Phillips Petroleum Company, and the SHELLSOL series available from the Shell Oil Company.

The amount of the liquid employed in the marking material may be, for example, from about 50 to about 99.9%, for example from abut 70 to about 99%, by weight of the total marking material. The total solids of the liquid marking material may be from, for example, about 0.1 to about 50% by weight, such as from about 0.3 to about 25% by weight or from about 0.3 to about 15% by weight, of the marking material.

The liquid marking material may comprise a liquid ink developer, and may thus also include, in addition to the vehicle and nanoparticles, charge control additives such as charge directors, resin material, colorants such as toner, pigments, dyes, or combinations or mixtures of pigments, dyes and/or toners, surfactants, and the like.

Charge directors that may be used include, for example, zwitterionic diblock copolymer charge directors of poly(2-ethylhexyl methacrylate-co-N,N-dimethyl-N -methylenecarboxylate-N-ammoniumethyl methacrylate), poly(2-ethylhexyl methacrylate-co-N,N-dimethyl-N-propylenesulfonate-N-ammoniumethyl methacrylate), poly (2-ethylhexyl methacrylate-co-N,N-dimethyl-N-propylenephosphonate-N -ammoniumethyl methacrylate), poly(2-ethylhexy methacrylate-co-N,N-dinethyl-N-propylenephosphinate-N-ammoniumethyl methacrylate), poly(2-ethylhexyl methacrylate-co-N,N-dimethyl-N-propylenesulfinate-N -ammoniumethyl methacrylate), poly(2-ethylhexyl methacrylate-co-N,N-diethyl-N-methylenecarboxylate-N -ammoniumethyl methacrylate), poly(2-ethylhexyl methacrylate-co-N,N-diethyl-N-propylenesulfonate-N-ammoniumethyl methacrylate), poly(2-ethylhexyl methacrylate-co-N,N-dimethyl-N-butylenephosphonate-N -ammoniumethyl methacrylate), poly(2-ethylhexyl methacrylate-co-N,N-dimethyl-N-decamethylenephosphonate-N-ammoniumethyl methacrylate), poly(2-ethylhexyl methacrylate-co-N,N-dimethyl-N-decamethylenephosphinate-N -ammoniumethyl methacrylate), poly(2-ethylhexyl methacrylate-co-N,N-dimethyl-N-buylenecarboxylate-N-ammoniumethyl methacrylate), poly(2-ethylhexyl methacrylate-co-N,N-dimethyl-N -ethyleneoxyethylenecarboxylate-N-ammoniumethyl methacrylate), poly(2-ethylhexyl methacrylate-co-N,N-dimethyl-N-ethyleneoxyethylene-sulfonate-N-ammoniumethyl methacrylate), poly(2-ethylhexyl methacrylate-co-N,N-dimethyl-N -ethyleneoxyethylenephosphonate-N-ammoniumethyl methacrylate), poly(N,N-dibutylmethacrylamido-co-N,N-dimethyl-N-methylenecarboxylate-N -ammoniumethyl methacrylate), poly(N,N-dibutylmethacrylamido-co-N,N-dimethyl-N-propylenesulfonate-N -ammoniumethyl methacrylate), mixtures thereof and the like. The charge director may be included in an amount such as, for example, from about 0.5% to about 30% by weight of the solids, or from about 1% to about 20% by weight of the solids. Charge additives such as alkyl pyridinium halides, sulfates, bisulfates, negative charge enhancing additives like aluminum complexes, and the like may also be used.

Suitable resins that may be included are, for example, resins such as polyester, polystyrene, polyacrylate, and the like. Examples of such resins include ethylene vinyl acetate (EVA) copolymers (ELVER resins, E. I. DuPont de Nemours and Company); polymers and copolymers of an α,β-ethylenically unsaturated acid selected from the group consisting of acrylic acid and methacrylic acid; copolymers of ethylene and acrylic or methacrylic acid; polyethylene; polystyrene; polypropylene; ethylene ethyl acrylate series sold under the name BAKELITE (Union Carbide Corporation); ethylene vinyl acetate resins; SURLYN ionomer resin (E. I. DuPont de Nemours and Company); polyesters; polyvinyl toluene; polyamides; styrene/butadiene copolymers; epoxy resins; acrylic resins, such as a copolymer of acrylic or methacrylic acid; and at least one alkyl ester of acrylic or methacrylic acid wherein alkyl is from 1 to about 20 carbon atoms like methyl methacrylate/methacrylic acid/ethylhexyl acrylate; and other acrylic resins including ELVACITE acrylic resins (E. I. DuPont de Nemours and Company); NUCREL resins; or blends thereof: Illustrative examples of specific resin include known polymers such as poly(styrene-butadiene), poly (paramethyl stytene-butadiene), poly(meta-methyl styrene-butadiene), poly(alpha-methyl styrene-butadiene), poly(methylmethacrylate-butadiene), poly(ethylmethacrylate-butadiene), poly(propylmethacrylate-butadiene), poly (butylmethacrylate-butadiene), poly(methylacrylate-butadiene), poly(ethyl acrylate-butadiene), poly (propylacrylate-butadiene), poly(butylacrylate-butadiene), poly(styrene-isoprene), poly(para-methyl styrene-isoprene), poly(metamethyl styrene-isoprene), poly(alpha-methylstyrene-isoprene), poly(methylmethacrylate-isoprene), poly (ethylmethacrylate-isoprene), poly(propylmethacrylate-isoprene), poly(butylmethacrylate-isoprene), poly (methylacrylate-isoprene), poly(ethylacrylate-isoprene), poly(propylacrylate-isoprene), and poly(butylacrylate-isoprene); polymers such as polystyrene-butadiene-acrylic acid), poly(styrene-butadiene-methacrylic acid), PLIOTONE available from Goodyear, polyethylene-terephthalate, polypropylene-terephthalate, polybutylene-terephthalate, polypentylene-terephthalate, polyhexylene-terephthalate, polyheptadene-terephthalate, polyoctalene-terephthalate, POLYLITE (Reichhold Chemical Inc), PLASTHALL (Rohm & Hass), CYGAL (American Cyanamide), ARMCO (Armco Composites), CELANEX (Celanese Eng), RYNITE (DuPont), STYPOL, and the like. The resin selected, which may be styrene acrylates, styrene butadienes, styrene methacrylates, or polyesters, may be present in amounts such as, for example, from about 25% to about 99% by weight of the solids, such as from about 50% to about 95% by weight of the solids.

The colorant may be selected from among pigments, dyes, mixtures of pigments, mixtures of dyes, mixtures of pigments and dyes, and/or mixtures of the foregoing with colorant containing toner. Colorants may be present in the marking material in an amount of, for example, from about 1 to about 25% by weight of the marking material such as from about 1 to about 15% by weight of the marking material. Any colorant may be chosen, provided that it is capable of being dispersed or dissolved in the ink vehicle and is compatible with the other ink components. Examples of suitable pigments include Violet PALIOGEN Violet 5100 (BASF); PALIOGEN Violet 5890 (BASF); HELIOGEN Green L8730 (BASF); LITHOL Scarlet D3700 (BASF); SUNFAST Blue 15:4 (Sun Chemical 249-0592); Hostaperm Blue B2G-D (Clariant); Permanent Red P-F7RK; Hostaperm Violet BL (Clariant); LITHOL Scarlet 4440 (BASF); Bon Red C (Dominion Color Company); ORACET Pink RF (Ciba); PALIOGEN Red 3871 K (BASF); SUNFAST Blue 15:3 (Sun Chemical 249-1284); PALIOGEN Red 3340 (BASF); SUNFAST Carbazole Violet 23(Sun Chemical 246-1670); LITHOL Fast Scarlet L4300 (BASF); Sunbrite Yellow 17 (Sun Chemical 275-0023); HELIOGEN Blue L6900, L7020 (BASF); Sunbrite Yellow 74 (Sun Chemical 272-0558); SPECTRA PAC C Orange 16 (Sun Chemical 276-3016); HELIOGEN Blue K6902, K6910 (BASF); SUNFAST Magenta 122 (Sun Chemical 228-0013); HELIOGEN Blue D6840, D7080 (BASF); Sudan Blue OS (BASF); NEOPEN Blue FF4012 (BASF); PV Fast Blue B2GO1 (Clariant); IRGALITE Blue BCA (Ciba); PALIOGEN Blue 6470 (BASF); Sudan Orange G (Aldrich), Sudan Orange 220 (BASF); PALIOGEN Orange 3040 (BASF); PALIOGEN Yellow 152, 1560 (BASF); LITHOL Fast Yellow 0991 K (BASF); PALIOTOL Yellow 1840 (BASF); NOVOPERM Yellow FGL (Clariant); Lumogen Yellow D0790 (BASF); Suco-Yellow L1250 (BASF); Suco-Yellow D1355 (BASF); Suco Fast Yellow D1 355, D1 351 (BASF); HOSTAPERM Pink E 02 (Clariant); Hansa Brilliant Yellow 5GX03 (Clariant); Permanent Yellow GRL 02 (Clariant); Permanent Rubine L6B 05 (Clariant); FANAL Pink D4830 (BASF); CINQUASIA Magenta (DU PONT), PALIOGEN Black L0084 (BASF); Pigment Black K801 (BASF); and carbon blacks such as REGAL 330™ (Cabot), Carbon Black 5250, Carbon Black 5750 (Columbia Chemical), mixtures thereof and the like. Examples of suitable dyes include Usharect Blue 86 (Direct Blue 86), available from Ushanti Color; Intralite Turquoise 8GL (Direct Blue 86), available from Classic Dyestuffs; Chemictive Brilliant Red 7BH (Reactive Red 4), available from Chemiequip; Levafix Black EB, available from Bayer; Reactron Red H8B (Reactive Red 31), available from Atlas Dye-Chem; D&C Red #28 (Acid Red 92), available from Warner-Jenkinson; Direct Brilliant Pink B, available from Global Colors; Acid Tartrazine, available from Metrochem Industries; Cartasol Yellow 6GF Clariant; Carta Blue 2GL, available from Clariant; and the like. Example dyes suitable for use herein may include Neozapon Red 492 (BASF); Orasol Red G (Ciba); Direct Brilliant Pink B (Global Colors); Aizen Spilon Red C-BH (Hodogaya Chemical); Kayanol Red 3BL (Nippon Kayaku); Spirit Fast Yellow 3G; Aizen Spilon Yellow C-GNH (Hodogaya Chemical); Cartasol Brilliant Yellow 4GF (Clariant); Pergasol Yellow CGP (Ciba); Orasol Black RLP (Ciba); Savinyl Black RLS (Clariant); Morfast Black Conc. A (Rohnm and Haas); Orasol Blue GN (Ciba); Savinyl Blue GLS (Sandoz); Luxol Fast Blue MBSN (Pylam); Sevron Blue 5GMF (Classic Dyestuffs); Basacid Blue 750 (BASF), Neozapon Black X51 [C.I. Solvent Black, C.I. 121.95] (BASF), Sudan Blue 670 [C.I. 61554] (BASF), Sudan Yellow 146 [C.I. 12700] (BASF), Sudan Red 462 [C.I. 260501] (BASF), mixtures thereof and the like.

Surfactants in amounts of, for example, 0.1 to about 25% by weight include, for example, nonionic surfactants such as diaikylphenoxypoly(ethyleneoxy)ethanol, available from Rhone-Poulenac as IGEPAL and ANTAROX surfactants, ad the like. Examples of anionic surfactants include, for example, sodium dodecylsulfate (SDS), sodium dodecylbenzene sulfonate, sodium dodecylnaphthalene sulfate, dialkyl benzenealkyl, sulfates and sulfonates, abitic acid, available from Aldrich, NEOGEN surfactants obtained from Kao, and the like. Examples of cationic surfactants include, for example, dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, dodecylbenzyl triethyl ammonium chloride, MIRAPOL and ALKAQUAT surfactants available from Alkaril Chemical Company, SANIZOL (benzalkonium chloride), available from Kao Chemicals, and the like, and mixtures thereof.

The marking material may also comprise a solid ink marking material, for example that produces amorphous or glassy polymer on cooling, The marking material is solid at room temperatures such as about 23° C. to about 27° C., and are desirably solid at temperatures below about 40° C. However, the marking material changes phase upon heating, and is in a molten state at jetting temperatures and has a viscosity of from about 1 to about 20 centipoise (cp), for example from about 5 to about 15 cp or from about 8 to about 12 cp, at an elevated temperature suitable for ink jet printing, for example temperatures of from about 60° C. to about 150° C. Amorphous or non-crystalline cold solid ink after deposition on the substrate may be achieved by fast cooling to produce glassy states. A solid ink composition from which most or all of the crystalline components have been removed is also suitable. Another way of producing glassy solid inks after deposition on the substrate is to add additives which prevent aggregation, thus crystallization of wax component materials of the ink.

Any suitable solid ink vehicle can be employed as the marking material vehicle. Suitable vehicles are described in, for example, U.S. Pat. No. 6,872,243 and application Ser. No. 11/548,775, each incorporated herein by reference in its entirety. Examples include paraffins, microcrystalline waxes, polyethylene waxes, ester waxes, amide waxes, fatty acids, fatty alcohols, fatty amides, such as monoamides, tetra-amides, and mixtures thereof and other waxy materials, sulfonamide materials, resinous materials made from different natural sources (such as, for example, tall oil rosins and rosin esters), and many synthetic resins, oligomers, polymers and copolymers, such as ethylene/vinyl acetate copolymers, ethylene/acrylic acid copolymers, ethylene/vinyl acetate/acrylic acid copolymers, copolymers of acrylic acid with polyamides, and the like, ionomers, and the like, as well as mixtures thereof. One or more of these materials can also be employed in a mixture with a fatty amide material and/or an isocyanate-derived material. Specific examples of suitable fatty amide vehicles include stearyl stearamide, a dimer acid based tetra-amide that is the reaction product of dimer acid, ethylene diamine, and stearic acid, a dimer acid based tetra-amide that is the reaction product of dimer acid, ethylene diamine, and a carboxylic acid having at least about 36 carbon atoms, and the like, as well as mixtures thereof. Also suitable as phase change ink vehicles are isocyanate-derived resins and waxes, such as urethane isocyanate-derived materials, urea isocyanate-derived materials, urethane/urea isocyanate-derived materials, mixtures thereof, and the like. Mixtures of fatty amide materials and isocyanate-derived materials can also be employed.

The solid ink vehicle may be present in the marking material in any desired or effective amount, for example from about 0.1% to about 99% by weight of the marking material such as from about 50% to about 99% by weight of the marking material.

The solid inks may also include additional components, for example including colorants such as discussed above, gelator additives such as described in U.S. Pat. No. 6,872,243, curing additives such as UV photoinitiators, and the like.

The marking vehicle may also be a radiation curable ink. Thus, the marking vehicle may comprise a radiation curable composition, comprising at least one curable monomer or oligomer, and at least one photoinitiator, to which the birefringent nanoparticles are added.

Examples of curable monomers for use in the radiation curable vehicle include propoxylated neopentyl glycol diacrylate, diethylene glycol diacrylate, triethylene glycol diacrylate, hexanediol diacrylate, dipropyleneglycol diacrylate, tripropylene glycol diacrylate, alkoxylated neopentyl glycol diacrylate, isodecyl acrylate, tridecyl acrylate, isobornyl acrylate, propoxylated trimethylolpropane triacrylate, ethoxylated trimethylolpropane triacrylate, di-trimethylolpropane tetracarylate, dipentaerythritol pentacarylate, ethoxylated pentaerythritol tetraacrylate, isobornyl methacrylate, lauryl acrylate, lauryl methacrylate, isodecylmethacrylate, caprolactone acrylate, 2-phenoxyethyl acrylate, isooctylacrylate, isooctylmethacrylate, butyl acrylate, mixtures thereof and the like.

Common oligomers that may be used in the composition of the curable vehicle include oligomers produced by Sartomer Company, BASF, Cognis Corporation, Cytec Industries Inc. (formerly UCB Surface Specialties). There are three major classes of oligomeric acrylates: epoxy, polyester and polyurethane. These oligomers include EBECRYL 812 (ex Cytec Industries Inc., formerly UCB); PO 83 F, PO94 F, and PO 33 F ex BASF; PHOTOMER 4967 and PHOTOMER 5429 ex Cognis; CN292, CN2204, CN131B, CN984, CN2300, CN549, CN501, CN2279, CN2284, CN2270 and CN384 ex SARTOMER; GENOMER 3364 and Genomer 3497 ex Rahn, mixtures thereof and the like. Monomers and oligomers may also be mixed. The vehicle may also include additional polymeric components, as desired.

The curable monomer or oligomer in embodiments is included in the vehicle in an amount of, for example, about 20 to about 90% by weight of the ink, such as about 30 to about 85% by weight of the ink, or about 40 to about 80% by weight of the ink.

Examples of photoinitiators used in the composition of the vehicle include 1-hydroxy-cyclohexylphenylketone, benzophenone, 2-benzyl-2-(dimethylamino)-1-(4-(4-morphorlinyl)phenyl)-1-butanone, 2-methyl-1-(4-methylthio)phenyl-2-(4-morphorlinyl)-1-propanone, diphenyl-(2,4,6-trimethylbenzoyl)phospine oxide, phenyl bis(2,4,6-trimethylbenzoyl)phosphine oxide, benzyl-dimethylketal, isopropylthioxanthone, mixtures thereof and the like. Any known photoinitiator may be used.

Often, several photoinitiators are used to efficiently harvest the light energy supplied by the radiation, for example UN, curing source. For instance, the phosphine oxide class of photoinitiators, such as diphenyl-(2,4,6-trimethylbenzoyl) phospine oxide, are known to be very light sensitive and absorb at longer wavelengths of light, for example, up to about 400 nm. These properties make this class of photoinitiators useful in pigmented inks because they absorb light where pigments often have little absorption (~400 nm) and their sensitivity allows these photoinitiators to initiate polymerization deep in a pigmented ink where little light has penetrated. Initiators with these properties are thus said to be useful for depth cure. However, the phosphine oxides may not efficiently initiate polymerizations in the presence of oxygen. Oxygen is known to interfere with free radical reactions. UV curing systems typically have sufficiently high levels of photoinitiator that there is enough to consume the oxygen present and initiate the polymerization. The difficulty arises when fresh oxygen can diffuse to the active free radical polymerization and slow or stop it. These conditions are most likely to occur at the surface of ink or coating when the irradiation takes place in air.

Other photoinitiator systems may be used to overcome the presence of higher levels of oxygen near the surface of the coating. Examples of photoinitiators that function well near the surface are 2-methyl-1-(4-methylthio)phenyl-2-(4-morphorlinyl)-1-propanone or the combination of isopropylthioxanthone or benzophenone and a suitable amine functionality such as the oligomer PO94 F from BASF or small molecule amines such as ethyl 4-(dimethylamino)benzoate. Such photoinitiator systems as these are said to be effective for surface curing.

The photoinitiators initiate the polymerization of activated carbon-carbon double bonds to form chains of single bonds. Activation of carbon-carbon double bonds to free radical polymerization is generally achieved through conjugation with other double bonds such as occurs with acrylate, methacrylate and styrenic groups. Styrene derivatives often have other photochemical pathways available to them that interfere with the desired polymerization or curing of the ink.

Methacrylate groups offer good mechanical properties upon cure but are typically slower to polymerize than acrylate groups. Thus, for rapidly curing inks for use in high speed printers, acrylate functionality may be the predominate type of reactive group. The monomers and oligomers may be chosen to provide good properties upon cure, rapid polymerization, low viscosity for jetting, and safe handling.

The total amount of photoinitiator included in the vehicle may be, for example, from about 0.5 to about 15%, such as from about 1 to about 10%, by weight of the vehicle.

The marking materials may also comprise toner, and thus the vehicle may comprise resin of toner particles. In this embodiment, the resin vehicle may be any resin used in forming a toner. Examples of suitable toner resins include vinyl polymers such as styrene polymers, acrylonitrile polymers, vinyl ether polymers, acrylate and methacrylate polymers, epoxy polymers, diolefins, polyurethanes, polyamides and polyimides, polyesters such as the polymeric esterification products of a dicarboxylic acid and a diol comprising a diphenol, combinations and mixtures thereof, and the like. The polymer resins selected for the toner may include homopolymers or copolymers of two or more monomers. Furthermore, the above-mentioned polymer resins may also be crosslinked.

Linear unsaturated polyesters that may be selected as the vehicle include, for example, low molecular weight condensation polymers which may be formed by the stepwise reactions between both saturated and unsaturated diacids (or anhydrides) and dihydric alcohols (glycols or diols). Suitable diacids and dianhydrides include, for example, saturated diacids and/or anhydrides, such as for example succinic acid, glutaric acid, adipic acid, pimelic acid, suberic acid, azelaic acid, sebacic acid, isophthalic acid, terephthalic acid, hexachloroendo methylene tetrahydrophthalic acid, phthalic anhydride, chlorendic anhydride, tetrahydrophthalic anhydride, hexahydrophthalic anhydride, endomethylene tetrahydrophthalic anhydride, tetrachlorophthalic anhydride, tetrabromophthalic anhydride, and the like, and mixtures thereof; and unsaturated diacids and/or anhydrides, such as for example maleic acid, fumaric acid, chloromaleic acid, methacrylic acid, acrylic acid, itaconic acid, citraconic acid, mesaconic acid, maleic anhydride, and the like, and mixtures thereof. Suitable diols include, for example, propylene glycol, ethylene glycol, diethylene glycol, neopentyl glycol, dipropylene glycol, dibromoneopentyl glycol, propoxylated bisphenol A, 2,2,4-trimethylpentane-1,3-diol, tetrabromo bisphenol dipropoxy ether, 1,4-butanediol, mixtures thereof and the like.

The polyester base resin may be a poly(propoxylated bisphenol A fumarate). The polyester may be sulfonated.

In embodiments, the toner resin vehicle is one or more of poly(styrene-alkyl acrylate), poly(styrene-1,3-diene), poly (styrene-alkyl methacrylate), poly (styrene-alkyl acrylate-acrylic acid), poly(styrene-1,3-diene-acrylic acid), poly(styrene-alkyl methacrylate-acrylic acid), poly(alkyl methacrylate-alkyl acrylate), poly(alkyl methacrylate-aryl acrylate), poly(aryl methacrylate-alkyl acrylate), poly(alkyl methacrylate-acrylic acid), poly(styrene-alkyl acrylate-acrylonitrile-acrylic acid), poly(styrene-1,3-diene-acrylonitrile-acrylic acid), and poly(alkyl acrylate-acrylonitrile-acrylic acid); poly(styrene-butadiene), poly(methylstyrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(m ethyl acrylate-isoprene), poly(ethyl acrylate-isoprene), poly(propyl acrylate-isoprene), poly(butyl acrylate-isoprene); poly(styrene-propyl acrylate), poly (styrene-butyl acrylate), poly(styrene -butadiene-acrylic acid), poly(styrene-butadiene-methacrylic acid), poly(styrene-butadiene-acrylonitrile-acrylic acid), polystyrene-butyl acrylate-acrylic acid), poly(styrene-butyl acrylate-methacrylic acid), poly(styrene-butyl acrylate-acrylonitrile), poly (styrene-butyl acrylate-acrylonitrile-acrylic acid), poly(styrene-butadiene), poly(styrene-isoprene), poly(styrene-butyl methacrylate), poly(styrene-butyl acrylate-acrylic acid), poly (styrene-butyl methacrylate-acrylic acid), poly(butyl methacrylate-butyl acrylate), poly(butyl methacrylate-acrylic acid), poly(acrylonitrile-butyl acrylate-acrylic acid), and mixtures thereof. A desirable polymer resin vehicle in this regard is poly(styrene/butyl acrylate/beta carboxyl ethyl acrylate).

The toner may also include additional additives and components, for example colorants as discussed above, charge controlling additives, external surface additives such as silica, titanitia zinc oxide, zinc stearate, and the like.

The nanoparticles may be dispersed in the vehicle of the marking material by any suitable method. For liquid marking materials, the nanoparticles may be dispersed directly in the liquid vehicle, for example by forming a dispersion of the nanoparticles with suitable surfactant(s). For solid marking materials, including solid inks and toners, the nanoparticles may be mixed with the resin vehicle and/or mixed with any other component of the marking material. For toners, the nanoparticles may be dispersed within the vehicle binder of the toner, contained as an external surface additive on the toner, included with another component of the toner, and the like.

Nanoparticle dispersions can be formulated by using appropriate dispersants. For example, if an aqueous ink is used, suitable dispersants may include, but are not limited to, SOLSPERSE® 40000, SOLSPERSE® 44000 from Noveon Inc., BYK® 181, BYK® 151, BYK® 156 from BYK Chemie Inc. If an organic or polymer organic ink is used, or if a toner is used, suitable dispersants may include, but are not limited to, for example, EFKA® 4046, EFKA® 7375 from Efka Additives, Inc., SOLSPERSE® 16000 from Noveon Inc., BYK® 9076, BYK® 9077 from BYK Chemie Inc, and the like.

In other embodiments, the nanoparticles may be functionalized with appropriate functional groups. For example, dispersion in aqueous systems is facilitated by functionalization of the nanoparticles surface with carboxylic acid groups. For dispersion in organic compositions like toner or UV curable inks, surface functionalization with alkyl groups or ester groups is suitable. A review on this subject can be found in Kohji Yoshinaga, Ch. 12.1, Surface modification of inorganic particles, in Surfactant Science Series (2000), p. 626-646. Suitable functional groups present on the surface of the nanoparticles thus may include long alkyl groups, for example from about 1 carbon atom to about 150 carbon atoms in chain length, such as from about 2 carbon atoms to about 125 carbon atoms or from about 3 carbon atoms to about 100 carbon atoms in chain length. Other suitable compatibilizing groups include esters, ethers, amides, carbonates and the like.

In embodiments, for the birefringent marking material, it is desirable that the sole capability of the birefringence is provided by the nanoparticles. In other words, the marking material is substantially free of any materials that exhibit birefringence besides the nanoparticles. Thus, for example, the birefringent marking material is desirably free of any other crystalline materials such as crystalline waxes or binders, crystalline external toner surface additives, and the like. As such, the marking material vehicle comprises an amorphous, non-cystalline material and is substantially free of crystalline material.

Excluding other materials that exhibit birefringence from the marking material is desirable in embodiments where the birefringent marking material is to be used in combination with additional non-birefringent marking materials of the same or different colors. In such embodiments, in order for the marking materials to have similar properties, for example similar gloss, charging or melting behavior, and the like, it is often the case that the different marking materials of the set will all be comprised of substantially similar vehicles, but differ in terms of the colorant used. If the birefringent marking material employs other materials exhibiting birefringence, the remaining marking materials used in a set for making an overall image may likely need to also contain these other birefringent materials for the above reasons. The intended birefringent marking material would then no longer be able to be differentiated from the other marking materials when located between crossed polarizers.

The birefringent marking materials herein may be employed in a variety of ink or toner sets. For example, in embodiments, the birefringent marking material may be used alone. This may be the case where the birefringent marking material does not contain a colorant and the nanoparticles are of sufficiently small size to appear substantially clear to a viewer. In such an embodiment, the birefringent marking material may be used as a clear material that may be used to overcoat or undercoat another image, or simply to mark an image receiving substrate, with hidden images such as hidden authentication information that is not perceived by a viewer at all unless the substrate is located between crossed polarizers. Under crossed polarizers, the image made by the birefringent marking material would be visible. The birefringent information located in the image or upon the substrate could not be reproduced by photocopying, and thus a simple authentication method is realized.

Of course, the birefringent marking material could also be used alone, but made to include a colorant therein. Portions of the image formed with the birefringent marking material would exhibit the desired birefringence under crossed polarizers.

In other embodiments, the birefringent marking material may be used in combination with another non-birefringent marking material of substantially a same color as the birefringent marking material. Color refers to, for example, the overall absorption characteristic within the same range of wavelengths of the electromagnetic spectrum. Marking materials having a substantially same color will appear to have substantially a same hue and contrast to an observer. Differently colored marking materials, on the other hand, exhibit a color, that is, an absorption characteristic, different from each other. Two marking materials, one of which is birefringent and one of which is not, may both exhibit, for example, a yellow color, a black color, and the like. In this manner, images can be formed with the marking materials, with only a portion of the image exhibiting that color being formed from the birefringent marking material. In this way, the image can include a security marking without a viewer even knowing because the viewer perceives a uniform color, and does not perceive any birefringence unless the image is located between two crossed polarizers. Such a marking material set could also be used to form an image or document with secret information buried therein, which information is revealed only to one knowing to place the image or document between crossed polarizers.

In still further embodiments, a marking material set may be comprised of at least three marking materials of different colors such as red, green and blue or yellow, cyan and magenta, optionally also including a marking material of black, with one or more of the marking materials, but not all of the marking materials, being the birefringent marking material. In this embodiment, the marking material set is comprised of at least three differently colored marking materials, wherein at least one of the marking materials is the birefringent marking material. This marking material set is thus able to form a full color image, and include the authenticating birefringence as only a portion of the overall image. Revelation of birefringence in only a portion of the image under crossed polarizers can confirm the authenticity of the image. Here again, this partial birefringence cannot be replicated by photocopying of an original image, and thus the marking materials herein provide a level of security in images formed using the marking materials.

The birefringent marking materials herein may be used to form an image upon an suitable image receiving substrate that is not crystalline, for example such as paper, for example translucent or semitransparent paper, transparency, plastic, and the like. Because detection of the birefringence is performed in transmission mode, by placing the document between two crossed polarizers, the substrate needs to be transparent or to have some degree of transparency at the detecting wavelength. The formed images may in turn be incorporated into any further application desired. For example, an image formed with the birefringent marking materials may be incorporated into a credit card or identification card, thereby allowing ready verification of the authenticity of the card due to the birefringent property included therein.

Images may be formed using the birefringent marking materials herein using any device and or method. For example, the marking materials may be liquid or solid inks, in which case an image can be formed by jetting and the like, for example with an ink jet type device. The marking materials maybe toners and/or developers, and thus an image may be formed by xerographic or electrostatographic devices employing any type of image development system therein. Conventional presses, and even writing devices such as pens and the like, might also be used.

In embodiments, described is a system for preparing and autheticating items. The system includes first an image forming device including at least one birefringent marking material comprising a marking vehicle and birefringent nanoparticles having an average particle size of less than about 700 nm. As above, the device receives an image forming substrate and forms an image thereon, at least a portion (but not all) of the image formed from the birefringent marking material. Second, the system also includes an authenticating device comprising a light source and two crossed polarizers capable of receiving therebetween an item comprised of the image receiving substrate. The crossed polarizers permit detection of the birefringence of a portion of the image, thereby confirming the authenticity of the image.

The light source may provide light of any suitable wavelength. It could be, for example, visible light, typically having a range of wavelengths from about 400 nm to about 800 nm. It may also be ultraviolet (UV) light of a wavelength comprised from about 20 nm to about 400 nm or infrared (IR) light having a wavelength higher than about 800 nm.

Embodiments described above will now be further illustrated by way of the following examples.

In this example, the image "ABC" as shown in the FIGURE is prepared. In the FIGURE, only the letter A of the image is formed from a birefringent marking material that contains nanoparticles. The letters B and C of the image are formed with the same marking material except that no nanoparticles or other birefringent materials are present. Under normal viewing conditions, for example ambient light, the viewer does not perceive any difference between the A, B and C letters. All appear to have the same color and appearance. However, when the image is viewed between crossed polarizers 10, 20 as in the FIGURE, desirably with a light source 30 for clear perception of the birefringence, only the letter A will be visible due to birefringence of the nanoparticles. Letters B and C will not be seen. This secret information can thus be used for authentication. If someone unaware of this protection method for this document tries to forge or photocopy it, such person will not know that only some parts of the image are birefringent, and will thus most likely produce an image that is either all together birefringent, where for example inks or toners using crystalline materials are used, or completely non-birefringent, where for example inks or toners free of crystalline materials are used.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, and are also intended to be encompassed by the following claims.

What is claimed is:

1. A birefringent marking material comprising a vehicle for the marking material and birefringent nanoparticles having an average particle size of less than about 700 nm;

wherein the birefringent nanoparticles are dispersed directly into the vehicle, the vehicle being non-birefringent and being a vehicle of a liquid ink, a liquid developer, a solid ink or a solid toner; and wherein the birefringent nanoparticles consist of nanoparticles exhibiting no perceptible color so as to appear clear to a viewer.

2. The birefringent marking material according to claim 1, wherein the birefringent marking material includes at least one colorant selected from the group consisting of pigment, dye, a mixture of pigments, a mixture of dyes and a mixture of pigment and dye.

3. The birefringent marking material according to claim 1, wherein the birefringent nanoparticles are inorganic and crystalline.

4. The birefringent marking material according to claim 3, wherein the birefringent nanoparticles comprise one or more of titanium dioxide, aluminum oxide, silicon dioxide or zinc oxide.

5. The birefringent marking material according to claim 1, wherein the birefringent nanoparticles have an average size of from about 1 nm to about 300 nm.

6. The birefringent marking material according to claim 1, wherein the nanoparticles comprise from about 0.1% to about 40% by weight of the birefringent marking material.

7. The birefringent marking material according to claim 1, wherein the marking vehicle comprises an amorphous, non-crystalline material and is substantially free of crystalline material.

8. A marking material set, comprising a birefringent marking material exhibiting a first color selected from the group consisting of cyan, yellow, magenta, red, green, blue and black, the birefringent marking material comprising a vehicle for the birefringent marking material and birefringent nanoparticles having an average particle size of less than about 700 nm, wherein the birefringent nanoparticles are dispersed directly into the vehicle, the vehicle being non-birefringent and being for a liquid ink, a liquid developer, a solid ink or a solid toner; and wherein the birefringent nanoparticles consist of nanoparticles exhibiting no perceptible color so as to appear clear to a viewer; and a non-birefringent marking material that is substantially free of crystalline materials and that exhibits a second color.

9. The marking material set according to claim 8, wherein the first color exhibited by the birefringent marking material and the second color exhibited by the non-birefringent marking material are substantially a same color.

10. The marking material set according to claim 8, comprised of at least three differently colored marking materials selected from among the group consisting of cyan, yellow, magenta, red, green, blue and black, wherein at least one but not all of the differently colored marking materials is the birefringent marking material and a remainder of the differently colored marking materials is the non-birefringent marking material.

11. The marking material set according to claim 10, wherein the ink set is comprised of four differently colored marking materials and including a cyan marking material, a magenta marking material, a yellow marking material and a black marking material.

12. An image receiving substrate comprised of a non-crystalline material and having an image thereon, wherein a portion of the image comprised of less than all of the image is formed from a birefringent marking material exhibiting no perceptible color so as to appear clear or exhibiting a color selected from the group consisting of cyan, yellow, magenta, red, green, blue and black, the birefringent marking material comprising a vehicle for the birefringent marking material and birefringent nanoparticles having an average particle size of less than about 700 nm, wherein the birefringent nanoparticles are dispersed directly into the vehicle, the vehicle being non-birefringent and being for a liquid developer, a solid ink or a solid toner; and wherein the birefringent nanoparticles consist of nanparticles exhibiting no perceptible color so as to appear clear to a viewer.

13. The image receiving substrate according to claim 12, wherein remaining portions of the image not formed from the birefringent marking material is formed from marking material substantially free of crystalline materials and not exhibiting birefringence.

14. The image receiving substrate according to claim 12, wherein the image receiving substrate comprises paper or non-crystalline plastic.

15. The image receiving substrate according to claim 12, wherein the image receiving substrate is part of a credit card or an identification card

16. The birefringent marking material according to claim 1, wherein surfaces of the birefringent nanoparticles are functionalized with one or more functional groups selected from the group consisting of carboxylic acid groups, alkyl groups, ester groups, ether groups, amide groups and carbonate groups.

17. The birefringent marking material according to claim 2, wherein the birefringent marking material exhibits a color selected from the group consisting of cyan, yellow, magenta, red, green, blue and black.

* * * * *